United States Patent [19]

Kirkpatrick

[11] 4,186,786

[45] Feb. 5, 1980

[54] COLORED INTERLOCKING CLOSURE STRIPS FOR A CONTAINER

[75] Inventor: George F. Kirkpatrick, Downers Grove, Ill.

[73] Assignee: Union Carbide Corporation, New York, N.Y.

[21] Appl. No.: 947,040

[22] Filed: Sep. 29, 1978

[51] Int. Cl.[2] ..... B65D 17/20

[52] U.S. Cl. ..... 150/3; 229/62

[58] Field of Search ..... 150/3; 229/66, 51 AS, 229/62; 264/171, 173, 95

[56] References Cited

U.S. PATENT DOCUMENTS

| | | | |
|---|---|---|---|
| 2,421,067 | 5/1947 | Howe | 150/3 |
| 3,619,395 | 11/1971 | Skendzic | 264/173 |
| 3,625,270 | 12/1971 | Skendzic | 150/3 |
| 3,819,106 | 6/1974 | Schuster | 229/62 |

*Primary Examiner*—George T. Hall
*Attorney, Agent, or Firm*—David Fink

[57] ABSTRACT

An interlocking closure device comprising two closure profiles operable for being interlocked continuously over a predetermined length features the closure profiles having different colors, whereby the position of the closure profiles on a container can be easily identified visually in order to simplify the closing and opening of the container and/or the complete occlusion of the closure profiles can be easily verified visually.

14 Claims, 7 Drawing Figures

FIG. 1
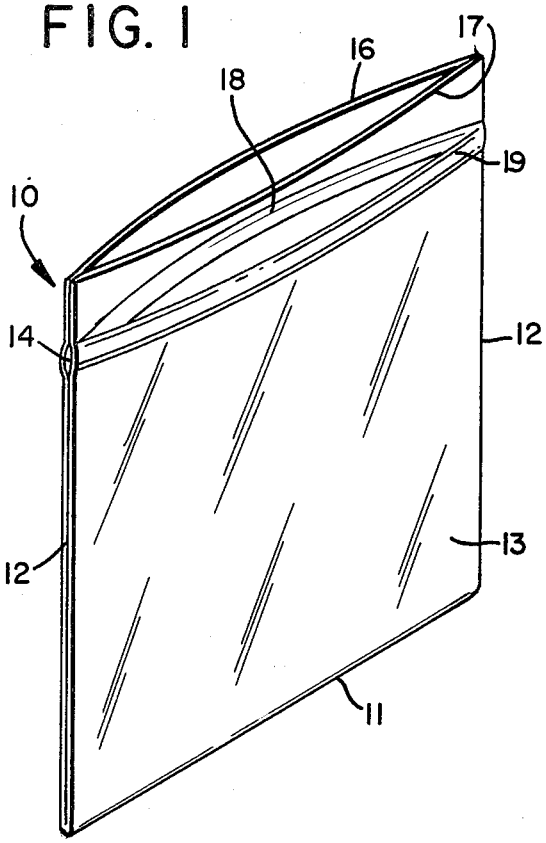
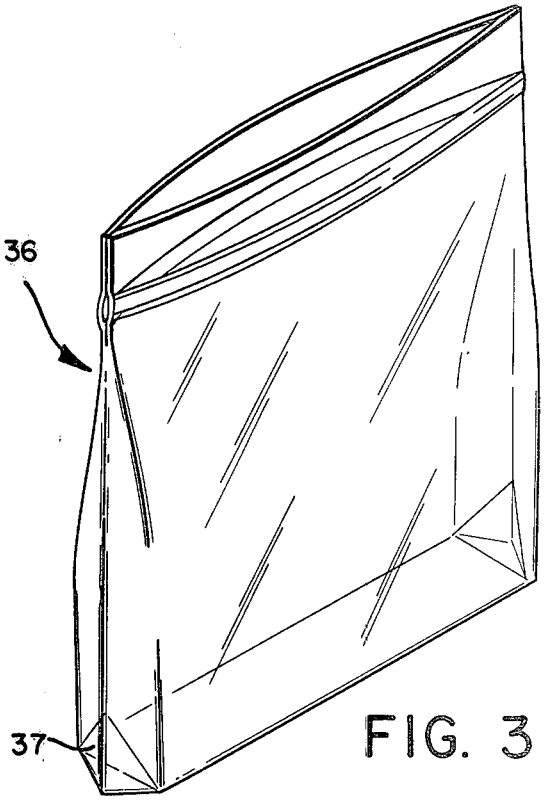
FIG. 3
FIG. 2(c)
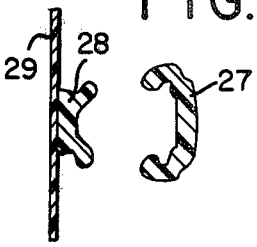
FIG. 2(a)
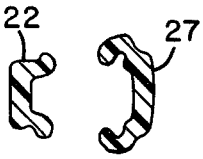
FIG. 4
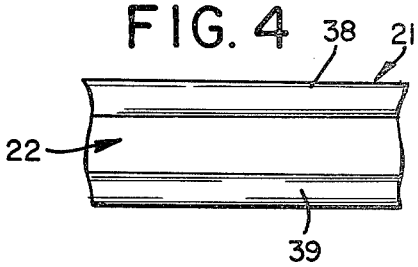
FIG. 2(b)
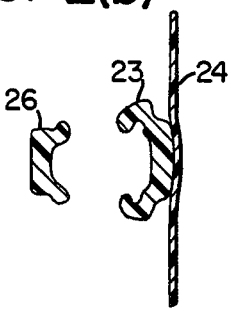
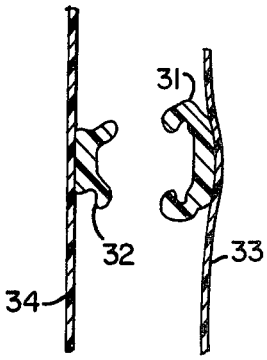
FIG. 2(d)

COLORED INTERLOCKING CLOSURE STRIPS FOR A CONTAINER

The invention relates to an interlocking closure device and more particularly to a closure device including two closure profiles operable for being interlocked continuously over a predetermined length.

Generally, an interlocking closure device for use in connection with flexible containers such as plastic bags and the like are well-known. Furthermore, manufacturing methods for closure devices made of plastic material are generally well-known.

It is also well-known that such closure devices may be interlocked by a slider or they my be sliderless.

A container including an interlocking closure device which is capable of being continuously interlocked should enable the user to occlude the closure device easily and to verify visually that the occlusion is complete.

In the prior art, it is known to identify the openable end of a container with a colored stripe. The stripe is spaced away from the closure device and therefore does not identify the actual position of either of the closure profiles.

Moreover, the stripe provides no information as to the completeness of the occlusion of the closure device.

The instant invention overcomes the aforementioned problems to provide closure devices having improved consumer appeal and marketability.

As used herein, closure profiles are continuous strips having respective cross sections which enable the closure profiles to be interlocked.

A closure profile can include a flanged portion and can be connected to a sidewall of a container.

As used herein, the term "connected" includes an integral combination obtained from extrusion through the same die opening as well as adhesive or cohesive connections.

As used herein, the term "color" includes clear transparent and tinted transparent and, similarly, clear translucent and tinted translucent.

One embodiment of the present invention is an interlocking closure device comprising two closure profiles operable for being interlocked continuously over a predetermined length, wherein the improvement comprises the closure profiles having different colors, whereby the position of the profiles on a container can be easily identified visually to simplify the closing and opening of the container and/or the complete occlusion of the closure profiles can be easily verified visually.

Another embodiment of the invention is a container comprising two flexible sidewalls and an interlocking closure device including two closure profiles operable for being interlocked continuously over a predetermined length connected to the sidewalls, wherein the improvement comprises the closure profiles having different colors, whereby the position of the profiles on the sidewall can be identified visually easily to simplify the closing and opening of the container.

A further embodiment of the invention is a container comprising two flexible sidewalls, and an interlocking closure device including two closure profiles operable for being interlocked continuously over a predetermined length connected to the sidewalls, wherein the improvement comprises the closure profiles having different primary colors selected to produce a predetermined secondary color, whereby the complete occlusion of the closure profiles can be identified visually easily.

Another further embodiment of the invention is one or both of the closure profiles of the invention including a flange portion.

The invention accordingly comprises the features of construction, combination of elements and arrangement of parts which will be exemplified in a construction hereinafter set forth and the scope of the application of which will be indicated in the claims.

Generally, the closure device of the invention can be made from polyethylene, polypropylene, nylon, or any other flexible thermoplastic material or the like or a combination thereof.

The closure device can be of the type in which one closure profile partially encircles the other closure profile such as the closure device shown in reissue U.S. Pat. No. Re 28,969 to Naito. The closure can also be of the type in which each of the closure profiles includes a plurality of hook portions and the closure profiles engage to establish occlusion, for example, as shown in U.S. Pat. No. 3,054,434 to Ausnit et al, FIG. 5.

The use of different colors for the interlocking closure is advantageous for both a sliderless closure device as well as a closure device having a slider. The use of different colors for the closure profiles is advantageous for a sliderless interlocking closure device because of the absence of a slider to provide a mechanical indication of the opening of the container. The use of different colors for the closure profiles is particularly advantageous for both the slidered closure device and the sliderless closure device because, as shall be seen more clearly herinafter, the use of the colored closure profiles provides means for easy visual verification of complete occlusion of the closure profiles when interlocking the closure device.

For a fuller understanding of the nature and objects of the invention, reference should be had to the following detailed description, taken in connection with the accompanying drawings, in which:

FIG. 1 is a perspective view of a flexible container including a closure device in accordance with the invention;

FIGS. 2A, 2B, 2C, and 2D are diagrammatic and sectional views of closure devices in accordance with the invention;

FIG. 3 is a perspective view of a flexible container having a gusseted bottom and including a closure device in accordance with the invention; and FIG. 4 is a side elevational view of the closure device of FIG. 2A in an occluded state.

In carrying the invention into effect, certain embodiments have been selected for illustration in the accompanying drawings and for description in this specification, reference being had to FIGS. 1 to 4.

FIG. 1 shows a typical flexible container 10 formed from a thin, transparent, plastic film which has been folded to define a bottom portion 11 and heat sealed along vertical side edges 12 to form a pouch.

The sidewalls 13 extend beyond a sliderless closure device 14 to provide mouth portions 16 and 17 to simplify the opening of the closure device 14.

The closure device 14 includes closure profiles 18 and 19. In accordance with the art, the end portions of the closure profiles 18 and 19 are connected to each other.

The closure profiles 18 and 19 are different colors to be easily identified visually. The sidewalls 13 are transparent, but could be opaque. If the sidewalls 13 were opaque, then at least one of the closure profiles should be a color which can be easily distinguished from the sidewall region adjacent to it.

Preferably, the sidewalls 13 are transparent at least in the region adjacent to the closure profiles 18 and 19.

FIGS. 2A, 2B, 2C, and 2D show different embodiments of the interlocking closure devices of the invention. FIG. 2A shows closure profiles 21 and 22 which are flangeless and are intended to be connected to opposite sidewalls of a container. FIG. 2B shows closure profile 23 including a flange portion 24 and flangeless closure profile 26. FIG. 2C shows flangeless closure profile 27 and closure profile 28 including a flange portion 29. FIG. 2D shows closure profiles 31 and 32 including flange portions 33 and 34.

Preferably, the flange portion is clear transparent, but the flange portion could be tinted some color or even be opaque. The flange portion could have a predetermined color while the remainder of the closure profile is transparent.

FIG. 3 shows a container 36 similar to the container 10, but including a gusseted bottom 37, thus providing a stand-up interlocking closure bag.

FIG. 4 shows that the occluded closure device of FIG. 2A results in the female closure profile 21 having borders 38 and 39 on opposite sides of portions of the male closure profile 22.

Because the closure profiles 21 and 22 are different colors, the completeness of the occlusion can be easily verified visually by observing the relationship between the continuous borders 38 and 39 with respect to the closure profile 22. Preferably, the closure profiles 21 and 22 should be contrasting opaque colors to optimize the ease in visually identifying the completeness of the occlusion.

The sidewalls of a container used in connection with the closure profiles 21 and 22 should be transparent at least in the region adjacent to the closure profiles 21 and 22.

The closure profiles 21 and 22 for another embodiment can be primary colors and sufficiently translucent so that the occlusion of the closure profiles 21 and 22 produces a visible secondary color. Thus, the completeness of the occlusion can be determined visually easily by observing a continuous region of the secondary color bordered on each side by one of the primary colors depending upon the side being viewed.

For example, one closure profile can be colored red and the other colored yellow so that occlusion of the closure profile produces an orange colored continuous region.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. A container comprising two flexible sidewalls and an interlocking closure device including two closure profiles operable for being interlocked continuously over a predetermined length and connected to said sidewalls, wherein the improvement comprises said closure profiles having different colors for establishing visually the completeness of the occlusion of said closure profiles.

2. The container claimed in claim 1, wherein each of said closure profiles is a translucent primary color thereby producing a predetermined secondary color when said closure profiles are occluded.

3. The container as claimed in claim 1, wherein one of said closure profiles partially encircles the other closure profile when said closure profiles are occluded.

4. The container as claimed in claim 1, wherein at least one of said closure profiles includes a flange portion.

5. The container as claimed in claim 4, wherein said flange portion and the remainder of said one closure profile are different colors.

6. The container as claimed in claim 5, wherein said flange portion is transparent.

7. The container as claimed in claim 5, wherein said remainder of said one closure profile is transparent.

8. The container claimed in claim 1, wherein each of said closure profiles includes a flange portion.

9. The container as claimed in claim 1, wherein the bottom portion of said container is gusseted.

10. The container as claimed in claim 1, wherein said sidewalls are transparent at least in the region adjacent to said closure profiles.

11. The container as claimed in claim 1, wherein said sidewalls are opaque.

12. The container as claimed in claim 1, wherein each of said closure profiles includes a plurality of hook portions.

13. The container as claimed in claim 1, wherein at least one of said closure profiles passes sufficient light to be at least translucent.

14. The container as claimed in claim 1, wherein at least one of said closure profiles is opaque.

* * * * *